US008272716B2

(12) United States Patent
Clarke

(10) Patent No.: US 8,272,716 B2
(45) Date of Patent: Sep. 25, 2012

(54) METHOD OF CONTINUOUS INKJET PRINTING

(75) Inventor: Andrew Clarke, Haslingfield (GB)

(73) Assignee: Eastman Kodak Company, Rochester, NY (US)

( * ) Notice: Subject to any disclaimer, the term of this patent is extended or adjusted under 35 U.S.C. 154(b) by 335 days.

(21) Appl. No.: 12/664,943

(22) PCT Filed: Jun. 11, 2008

(86) PCT No.: PCT/GB2008/001975

§ 371 (c)(1),
(2), (4) Date: Dec. 16, 2009

(87) PCT Pub. No.: WO2009/004280

PCT Pub. Date: Jan. 8, 2009

(65) Prior Publication Data

US 2010/0188462 A1 Jul. 29, 2010

(30) Foreign Application Priority Data

Jul. 3, 2007 (GB) ..... 0712862.2

(51) Int. Cl.
*B41J 2/14* (2006.01)
*B41J 29/38* (2006.01)

(52) U.S. Cl. ..... 347/47; 347/6

(58) Field of Classification Search ..... None
See application file for complete search history.

(56) References Cited

U.S. PATENT DOCUMENTS

| | | | | |
|---|---|---|---|---|
| 5,113,198 | A | 5/1992 | Nishikawa et al. | |
| 6,377,387 | B1 | 4/2002 | Duthaler et al. | |
| 6,554,410 | B2 | 4/2003 | Jeanmaire | |
| 6,713,389 | B2 | 3/2004 | Speakman | |
| 7,607,766 | B2 * | 10/2009 | Steiner | 347/73 |

FOREIGN PATENT DOCUMENTS

| | | |
|---|---|---|
| EP | 1364718 | 10/2007 |
| JP | 1996207318 | 8/1996 |
| WO | WO 03/004146 | 1/2003 |
| WO | WO 2006/038979 | 4/2006 |

* cited by examiner

*Primary Examiner* — Matthew Luu
*Assistant Examiner* — Renee I Wilson
(74) *Attorney, Agent, or Firm* — William R. Zimmerli

(57) ABSTRACT

A liquid jet is ejected out of a nozzle, the liquid comprising one or more components, the flow of one or more of said components, the active components, being separated such that the liquid that flows within a boundary layer thickness δ, of the nozzle wall is substantially comprised of a liquid without the active components, the continuous phase, and the said active components flow substantially outside said boundary layer where δ is defined by formula (I): where μ is the continuous phase viscosity in Pa·s, U is the jet velocity in m/s ρ is the continuous phase density in kg/m3 and x is the length of the nozzle in m in the direction of flow.

$$\delta = \sqrt{\frac{\mu x}{\rho U}} \quad \text{(I)}$$

18 Claims, 2 Drawing Sheets

METHOD OF CONTINUOUS INKJET PRINTING

FIELD OF THE INVENTION

This invention relates to the field of continuous ink jet printing, especially in relation to inks or other jettable compositions containing dispersed components.

BACKGROUND OF THE INVENTION

With consumer printer market growth, inkjet printing has become a broadly applicable technology for supplying small quantities of liquid to a surface in an image-wise way. Both drop-on-demand and continuous drop devices have been conceived and built. Whilst the primary development of inkjet printing has been for graphics using aqueous based systems with some applications of solvent based systems, the underlying technology is being applied much more broadly.

There is a general trend of formulation of inkjet inks toward pigment based ink. This generates several issues that require resolution. Further, for industrial printing technologies, i.e. employing printing as a means of manufacture, the liquid formulation may contain solid or dispersed components that are inherently difficult to handle with inkjet processes.

A new continuous inkjet device based on a MEMs formed set of nozzles has been recently developed (see U.S. Pat. No. 6,554,410). In this device a liquid ink jet is formed from a pressurized nozzle. One or more heaters are associated with each nozzle to provide a thermal perturbation to the jet. This perturbation is sufficient to initiate break-up of the jet into regular droplets through the well known Rayleigh-Plateau instability. By changing the timing of electrical pulses applied to the heater large or small drops can be formed and subsequently separated into printing and non-printing drops via a gaseous cross flow.

Inkjet drop generation devices are microfluidic devices in that they employ very small scale liquid channels. The implication of this is that the Reynolds number $$Re = \frac{\rho U L}{\mu}$$

where ρis the liquid density (kg/m$^3$), U is a characteristic velocity (m/s), L a characteristic length (m) and μ the liquid viscosity, (Pa·s), is sufficiently small that inertial effects are small and the flow is predominantly laminar in nature. For a typical continuous inkjet system the velocity might be 20 m/s and a length might be 5 μm with a density approximately 1000 kg/m$^3$ and a viscosity of 1 mPas. The Reynolds number is therefore approximately 100. The transition to turbulent flow in a straight pipe occurs at Re above approx 2000.

Microfluidic devices where the liquid flow is laminar necessarily prevent mixing. In fact the only mechanism available for mixing is diffusional flow. For example, consider a T junction in which two fluids are injected to flow alongside each other. How far down the channel must the fluids flow before the channel is homogenized? A simple estimate requires the particles or molecules to diffuse across the entire channel, giving a time $t_D \sim w^2/D$, where w is the width of the channel and D is the diffusion constant. During this time, the material will have moved a distance $z \sim U_0 w^2/D$ down the channel, so that the number of channel widths required for complete mixing would be of order $$\frac{Z}{w} \approx \frac{U_0 w}{D} \equiv Pe$$

The dimensionless number on the right is known as the Péclet number (Pe), which expresses the relative importance of convection to diffusion. In this example, the number of channel widths required for full mixing varies linearly with Pe. Using the diffusivities in the table below estimated using the Stokes-Einstein relation, we see that even a dye molecule flowing with the fluid through a 10 μm channel at 1 m/s requires Pe~250000 channel widths to completely mix. Alternatively, that dye molecule flowing with the fluid at 1 m/s would require a pipe length z~25 mm to diffuse 1 μm.

Characteristic Diffusivities in water at room temperature

| Particle | Typical size | Diffusion constant |
|---|---|---|
| Solute ion | $10^{-1}$ nm | $2 \times 10^3$ μm$^2$/s |
| Dye molecule | 5 nm | 40 μm$^2$/s |
| Colloidal particle | 100 nm | 2 μm$^2$/s |
| Bacterium | 1 μm | 0.2 μm$^2$/s |
| Mammalian/human cell | 10 μm | 0.02 μm$^2$/s |

When a liquid flows across a surface the velocity of the liquid at the solid surface is zero. In a long pipe the maximum liquid velocity is found in the centre of the pipe and the velocity profile across the pipe is parabolic. This is referred to as Poiseiulle flow. However, on entry to a pipe there is a finite distance, the entry region, where the flow field adopts that consistent with the pipe geometry. In the terminology of fluid mechanics there is a boundary layer that forms and grows until it is the size of the pipe at which point fully developed flow is achieved. The boundary layer thickness may be calculated as $$\delta = \sqrt{\frac{\mu x}{\rho U}}$$

where δ is the boundary layer thickness (m), μ is the liquid viscosity (Pa·s), x is the distance from the start of the pipe (m), ρ is the liquid density (kg/m$^3$) and U the liquid velocity (m/s). The nozzle in an inkjet droplet generator is a very short pipe i.e. too short for fully developed flow to be achieved. Therefore only a boundary layer thickness of liquid next to the nozzle wall is sheared.

There are numerous known methods and devices relating to the formation of droplets.

EP1364718 discloses a method of generating encapsulated droplets via co flowing immiscible liquids. In this method the liquids are supplied by coaxially arranged nozzles, which are difficult to manufacture as an array. Further, this method relies on a strong electrostatic field to ensure break-up of the coaxially arranged liquids.

JP1996207318 again uses coaxial tubes and electrostatics to break off a droplet. The centre tube in this case can supply colloidal particles or a plurality of them to provide a colour level. Electrophoretic means can stop the flow of particles by arrangement of electric fields.

U.S. Pat. No. 6,713,389 describes placing multiple discrete components on a surface for the purpose of creating electronic devices.

U.S. Pat. No. 5,113,198 describes using a carrier gas stream to direct vaporous dyes toward a surface. This uses co flowing gas streams but no liquids.

U.S. Pat. No. 6,377,387 describes various methods for generating encapsulated dispersions of particles.

WO2006/038979 describes a drop on demand piezo electric device where liquids are brought together external to the device structure.

PROBLEM TO BE SOLVED BY THE INVENTION

There are several problems relating to the formulation of ink drops where the ink contains dispersed material.

Inks containing dispersed material or particulates give rise to increased noise, i.e. to increased drop velocity variation. This leads to reduced small drop merger length. Small drop merger length is a key property of the MEMs continuous ink jet (CIJ) system. This is the distance from the nozzle at which neighbouring droplets touch and coalesce due to randomness in their velocities. Particulates or dispersed material in the ink cause this length to be significantly reduced.

Particulates in the ink formulation are also detrimental to the ink jet nozzle, causing wear.

Any temperature sensitive dispersed material that is in close proximity to the nozzle wall, and therefore to the embedded heater, could potentially be a problem, either because it adheres to the wall or because its properties are adversely affected, e.g. through colloidal destabilisation and aggregation.

High viscosity liquids, e.g. UV cureable inks, are difficult to jet because of the pressure drop associated with the necessary small nozzle size. This pressure drop provides the shear stress associated with the boundary layer in the nozzle.

The present invention aims to address these problems.

SUMMARY OF THE INVENTION

The present invention seeks to spatially separate the components in the ink that adversely interact with the nozzle from the vicinity of the nozzle walls.

According to the present invention there is provided a method of providing a liquid jet for ejection out of a nozzle, the liquid comprising one or more components, wherein the flow of one or more of said components, the active components, is separated such that the liquid that flows within a boundary layer thickness δ, of the nozzle wall is substantially comprised of a liquid without the active components, the continuous phase, and the said active components flow substantially outside said boundary layer where δ is defined by $$\delta = \sqrt{\frac{\mu x}{\rho U}}$$

wherein μ is the continuous phase viscosity in Pa·s, U is the jet velocity in m/s ρ is the continuous phase density in kg/m3 and x is the length of the nozzle in m in the direction of flow.

ADVANTAGEOUS EFFECT OF THE INVENTION

By ensuring the dispersed components or particles cannot come into contact with the wall the possibility of wear is removed.

Since the fluidic system to separate the flows can be bigger than the nozzle, the issues of particles or components blocking the nozzle are ameliorated. Since particles are kept away from the nozzle wall there is no hard surface to jam against.

Furthermore by ensuring the dispersed material is kept away from the walls, and therefore from the thermal boundary layer, there is a significantly reduced thermal degradation effect on the dispersed material. Further, there is less possibility of material adhering to the walls.

As it is the interaction of dispersed material or particulates with the boundary layer within the nozzle that generates the observed drop velocity fluctuations, by keeping that material out of the nozzle boundary layer, the small drop merger length determined by the background fluid can be realised.

It is the viscosity of the liquid in the boundary layer that is responsible for the pressure drop required for a particular jetting velocity thus, for example, by addition of solvent as a thin layer surrounding a UV curable ink, the shear in the nozzle is only experienced by the solvent and thus the jettability of the higher viscosity material i.e. the UV curable monomer is improved. Additionally it may be advantageous to increase the overall temperature of the ink composition to reduce its viscosity.

Since the break up of the jet is driven by the liquid surface tension and initially the subsurface viscosity (of the jet), by keeping dispersed material away from this region, it is the properties of the background fluid that determine the drop break-up dynamics rather than the dispersed components. Thus the range of dispersed components that may be chosen is significantly broadened.

BRIEF DESCRIPTION OF THE DRAWINGS

The invention will now be described with reference to the accompanying drawings in which.

DETAILED DESCRIPTION OF THE INVENTION

The invention relates to continuous ink jet printing rather than to drop on demand printing. Continuous ink jet printing uses a pressurized liquid source to feed a nozzle, which thereby produces a liquid jet. Such a liquid jet is intrinsically unstable and will naturally break to form a continuous stream of droplets. A perturbation to the jet at or close to the Rayleigh frequency, i.e. the natural frequency of break-up, will cause the jet to break regularly. The droplets of liquid or ink may then be directed as appropriate. The perturbation may be caused by, for example, one or more of a piezo element, a resistive heater element, an electro osmotic arrangement, an electrophoretic arrangement, or a dielectrophoretic arrangement. A continuous heater may additionally be provided to change the average temperature of the print head and thus modify the ink properties.

The liquid composition or ink may contain one or more dispersed or dissolved components including pigments, dyes, monomers, polymers, metallic particles, inorganic particles, organic particles, dispersants, latex and surfactants well known in the art of ink formulation. This list is not to be taken as exhaustive. The particles may be composite particles including polymers, metals, semiconductors, dielectrics or dispersants. This liquid composition is comprised of an active phase, containing all components, and a continuous phase in which one or more of the components of the active phase are not present. For the purpose of applying this invention a sacrificial continuous phase may also be added to the compositions.

Figure 1:
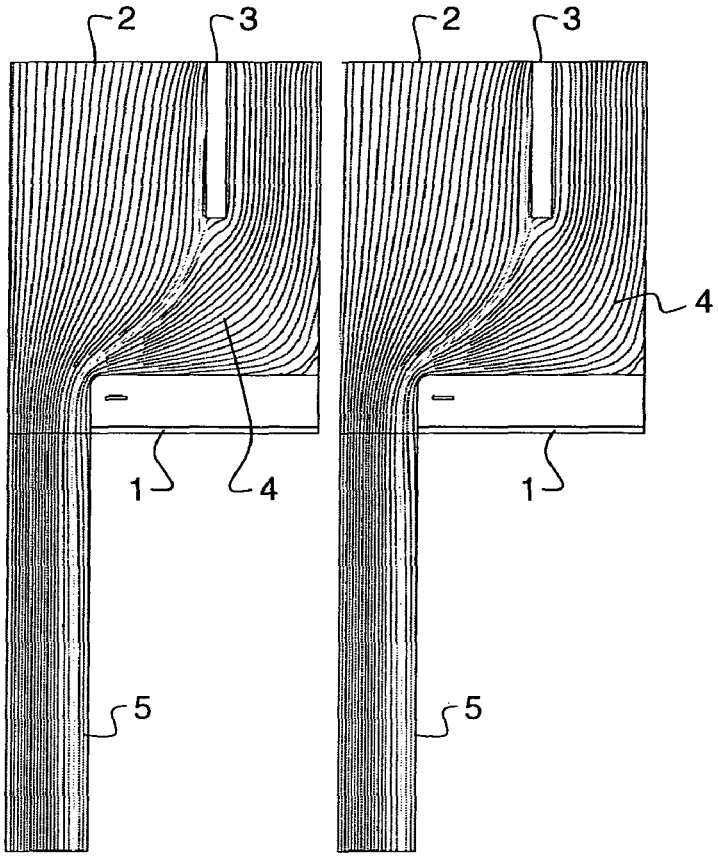
FIG. 1 is a cross-sectional view from a cylindrically symmetric fluid flow calculation illustrating the particulate matter staying in the central region of the fluid flow.

As illustrated in FIG. 1 a nozzle 1 is created such that there is a separated flow. The ink solution 2 containing the active phase to be printed (i.e. containing particles, polymer etc.) is directed to flow through the central region by an internal structure 3 and the continuous phase 4 is directed to the surrounding region.

The flows in each region are necessarily laminar and therefore the liquid in the surrounding region will stay next to the wall of the nozzle whilst the active material will be directed to the core of the jet. The only transport mechanism for material to migrate to the wall of the jet is diffusion. Thus provided the diffusion constant is small enough and the time of the flow in the nozzle region is short enough, there will be no opportunity for material to reach the wall. This is also true for molecularly dispersed (dissolved) material.

The composite laminar flow issues from the nozzle 1 to form a composite jet 5. In order that dispersed particulates do not mechanically jam the nozzle a common rule of thumb is that they should have a diameter no greater than ⅕ the diameter of the nozzle through which they travel. In the present device this rule of thumb relates to the orifice defining the flow of the active phase not the final orifice defining the jet. Hence, since the jet may be smaller than the orifice defining the internal flow, this rule of thumb with respect to the final orifice may be broken. The degree to which the rule of thumb may be broken will depend in particular on flow rates and density ratios due to inertial effects as will be appreciated by one skilled in the art. Further, the timescale of the flow ensures that diffusional processes for the active phase will not be significant.

Note that various arrangements might be considered that enable this.

Figure 2:
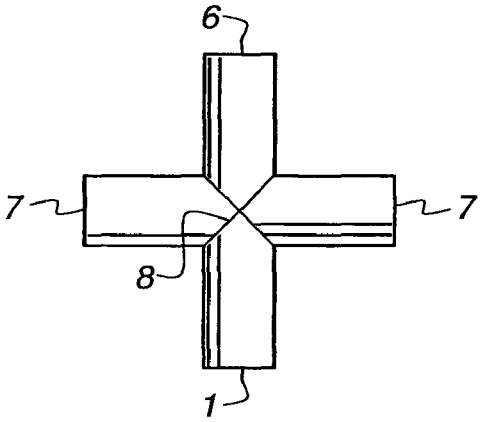
FIG. 2 is a copy of a photograph of a device enabling the method of the present invention.

One way to enable this is shown in FIG. 2. The device shown in FIG. 2 has a central arm 6 and opposing arms 7. The opposing arms 7 meet the central arm 6 at a junction 8. A nozzle 1 is provided down stream of the junction 8. The device may be fabricated in glass. However the invention is not so limited. The dimensions of each element of FIG. 2 are not critical but can easily be chosen by one skilled in the art to ensure laminar flow and an appropriate flow ratio for the appropriate device specification.

The particulate-containing ink is directed down the central arm 6. It will be understood that the invention is not limited to inks but includes any liquid which is to be jetted and laid down and that includes any dispersed matter. The opposed arms 7 direct flow substantially at the same pressure, at right angles to the flow of fluid travelling through the central arm 6. This angle is not critical but should preferably be chosen to ensure laminar flow without recirculation regions. The fluid travelling in the opposing arms 7 does not contain particulates and can comprise, for example, deionised water. The fluid travelling through the central arm is pushed towards the middle, ensuring that the particulates do not touch the wall of the nozzle, and will subsequently form a composite jet. Note that in this example the front and back walls of the device do contact the liquid containing dispersed matter. This is therefore not optimal and this deficiency may simply be alleviated by ensuring that central arm 6 is thinner than the junction region 8.

One obvious problem with the above device is that this requires two flows to be delivered to the CIJ head. One way of providing just one flow is to provide within the print head a permeable member that allows the solution without active material to pass, i.e. the continuous phase of the liquid, but not the active material.

Figure 3:
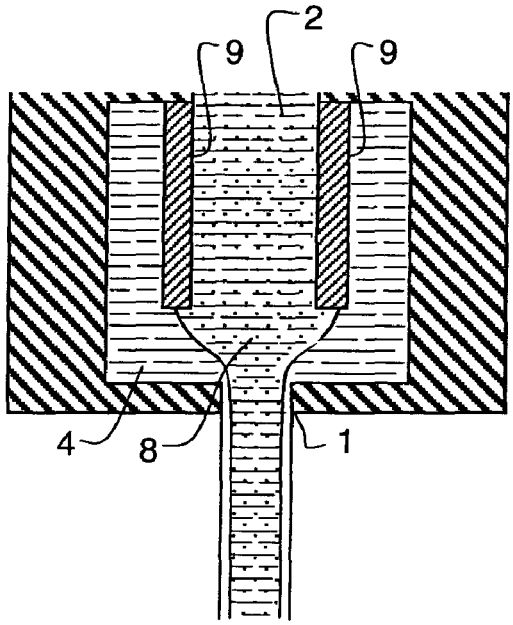
FIG. 3 is a schematic diagram of a device with a single liquid feed that enables the method of the present invention.
Figure 4:
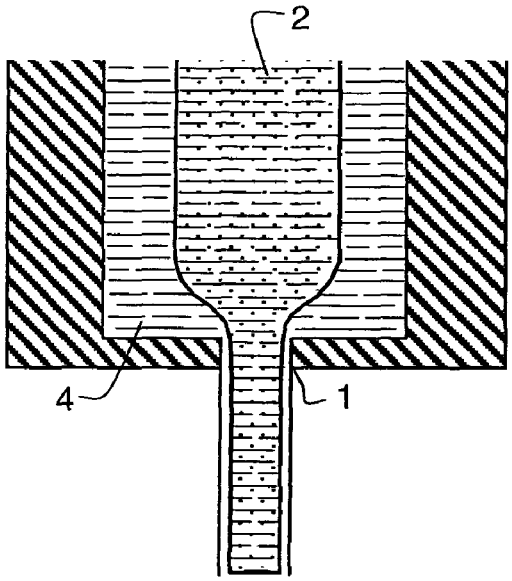
FIG. 4 is a schematic diagram showing separated flow forming a composite jet.

FIG. 3 shows a schematic example of such a device wherein a permeable structure 9 is provided to allow the liquid without dispersed material 4 to pass and so form a sheath around the liquid with dispersed material 2, the active phase. By arranging the permeable structure flow normal to the channel flow the structure will not block the flow. This structure may be physical, such as a porous membrane, or an electrostatic field, or any other method whereby the dispersed material is prevented from passing yet does not accumulate and block the structure.

It is well understood that a shear field or electrophoretic forces or dielectrophoretic forces or thermal gradients may be used to cause dispersed matter to be directed within a flow within a channel. Hence another solution would be to pre-prepare the flow field using such methods so that the dispersed, active, material is in the central region of the channel leading to the jet orifice such that a composite jet is formed.

The invention has been described in detail with reference to preferred embodiments thereof. It will be understood by those skilled in the art that variations and modifications can be effected within the scope of the invention.

The invention claimed is:

1. A method of ejecting a composite liquid jet from a nozzle, the method comprising providing a nozzle and a liquid, the nozzle including a wall, the nozzle being provided with an internal structure located upstream relative to the nozzle that separates a flow of the liquid comprising two phases, one phase being an active phase containing one or more components, the other phase being a continuous phase in which one or more of the active components is not present, the two phases being separated such that the liquid that flows within a boundary layer of the nozzle wall is substantially comprised of the continuous phase, the active phase being substantially excluded from the boundary layer, wherein the boundary layer has a thickness δ defined by $$\delta = \sqrt{\frac{\mu x}{\rho U}}$$

wherein μ is the continuous phase viscosity in Pa·s, U is the jet velocity in m/s ρ is the continuous phase density in kg/m3 and x is the length of the nozzle in m in the direction of flow; and pressurizing the liquid to cause a composite jet of the liquid to be ejected from the nozzle, the composite liquid jet including the active phase and the continuous phase.

2. A method as claimed in claim 1 wherein two separate liquid flows are supplied to channels in the region of the nozzle, a first liquid without said active components and a second liquid with said active components, the liquids being brought into contact prior to said nozzle.

3. A method as claimed in claim 1 wherein two opposing fluid flows comprising said liquid without the active components are directed towards a fluid flow comprising said liquid with the active components, thereby confining the active components towards the centre of the jet.

4. A method as claimed in claim 1 wherein the flow is separated by means of a permeable structure that does not allow the active components to pass.

5. A method as claimed in claim 4 wherein said permeable structure is arranged substantially parallel to the liquid flow.

6. A method as claimed in claim 4 wherein said permeable structure is created by electric fields.

7. A method as claimed in claim 1 wherein the liquid is an organic composition.

8. A method as claimed in claim 1 wherein the liquid is an aqueous composition.

9. A method as claimed in claim 1 wherein the active components include one or more components chosen from, a pigment, a dye, a monomer, a polymer, a particle, a dispersant, a surfactant, a latex.

10. A method as claimed in claim 9 wherein said particle includes one or more components chosen from, a polymer, a metal, a semiconductor, a dielectric, a dispersant to form a composite particle.

11. A print head for use in a continuous ink jet printer, the print head including one or more nozzles through which a composite jet of liquid is ejected, each nozzle including a wall, each nozzle provided with an internal structure located upstream relative to the nozzle that separates a flow of a composite liquid comprising two phases, one phase being an active phase containing one or more active components, the other phase being a continuous phase in which one or more of the active components is not present, the two phases being separated such that the liquid that flows within a boundary layer of the nozzle wall is substantially comprised of the continuous phase, the active phase being substantially excluded from the boundary layer, wherein the boundary layer has a thickness δ defined by $$\delta = \sqrt{\frac{\mu x}{\rho U}}$$

wherein μ is the continuous phase viscosity in Pa·s, U is the jet velocity in m/s ρ is the continuous phase density in kg/m3 and x is the length of the nozzle in m in the direction of flow.

12. A print head as claimed in claim 11 provided with means to perturb the jet issuing from each of said nozzles in a periodic manner, the means comprising one or more of a piezo element, a resistive heater element, an electro osmotic arrangement, an electrophoretic arrangement, a dielctrophoretic arrangement.

13. A print head as claimed in claim 11 additionally provided with a continuous heater to change the average temperature of the print head and thus modify the ink properties.

14. A printing system wherein the ink to be printed is delivered via a print head as claimed in claim 11.

15. A print head as claimed in claim 11 wherein the internal structure includes a permeable structure that does not allow the active components to pass.

16. A print head as claimed in claim 15 wherein the permeable structure is arranged substantially parallel to the liquid flow.

17. A print head as claimed in claim 15 wherein the permeable structure is created by an electric field.

18. A print head as claimed in claim 11 wherein the internal structure includes a physical wall.

* * * * *